US006607456B2

(12) United States Patent
Yu

(10) Patent No.: US 6,607,456 B2
(45) Date of Patent: Aug. 19, 2003

(54) SELF-LUMINOUS BASKET NET

(76) Inventor: Wan-Sheng Yu, P.O. Box 167, Lukang, Changhua County (TW)

( * ) Notice: Subject to any disclaimer, the term of this patent is extended or adjusted under 35 U.S.C. 154(b) by 0 days.

(21) Appl. No.: 09/921,576

(22) Filed: Aug. 6, 2001

(65) Prior Publication Data

US 2002/0119843 A1 Aug. 29, 2002

(30) Foreign Application Priority Data

Feb. 26, 2001 (TW) ..... 90202852 U

(51) Int. Cl.[7] ..... A63B 63/08
(52) U.S. Cl. ..... 473/485
(58) Field of Search ..... 473/485, 478, 473/479, 487, 489

(56) References Cited

U.S. PATENT DOCUMENTS 2,382,355 A * 8/1945 Warren
2,787,558 A * 4/1957 Woosley
5,192,080 A * 3/1993 Duncan
5,403,000 A * 4/1995 Woosley

* cited by examiner

*Primary Examiner*—Paul T. Sewell
*Assistant Examiner*—M. Chambers
(74) *Attorney, Agent, or Firm*—Troxell Law Office PLLC

(57) ABSTRACT

A self-luminous basket net being hung to an iron basket ring of a basket board is disclosed. The self-luminous basket net comprises a fabric rope, which is fabricated to be formed with as a lower half basket net with a plurality of basket meshes and an upper half basket net formed by a plurality of basket meshes; the plurality of basket meshes of the upper half basket net is self-luminous which is fabricated by a self-luminous plastic monofilament and hung from the iron basket ring; the basket net emits light at night so that the shooter can view the position of the basket net.

4 Claims, 3 Drawing Sheets

SELF-LUMINOUS BASKET NET

FIELD OF THE INVENTION

The present invention relates to a self-luminous basket net, and especially to basket net structure which can be seen at night.

BACKGROUND OF THE INVENTION

Basketball is a popular sport. Although some basketball fields have strong illumination, the basket ball fields in schools or public places are not all equipped with an illumination system, so that in night the illumination is not sufficient. This is inconvenient for young people so many young peoples are interested in electric games or networking, and thus are lack of exercise.

SUMMARY OF THE INVENTION

The primary object of the present invention is to provide a self-luminous basket net for resolving the defect in the prior art basket net, whereby the sportsman (or sportswoman) may play ball successfully at night.

To achieve the above and the other objectives, the present invention provides a self-luminous basket net being hung to an iron basket ring of a basket board, characterized in that the basket net comprises a fabric rope, which is fabricated to have a lower half basket net formed by a plurality of basket meshes and an upper half basket net formed by a plurality of basket meshes. The plurality of basket meshes of the upper half basket net is self-luminous and hung from the iron basket ring. The basket net emits light at night so that the shooter can view the position of the basket net.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention in the appended claims.

Figure 1:
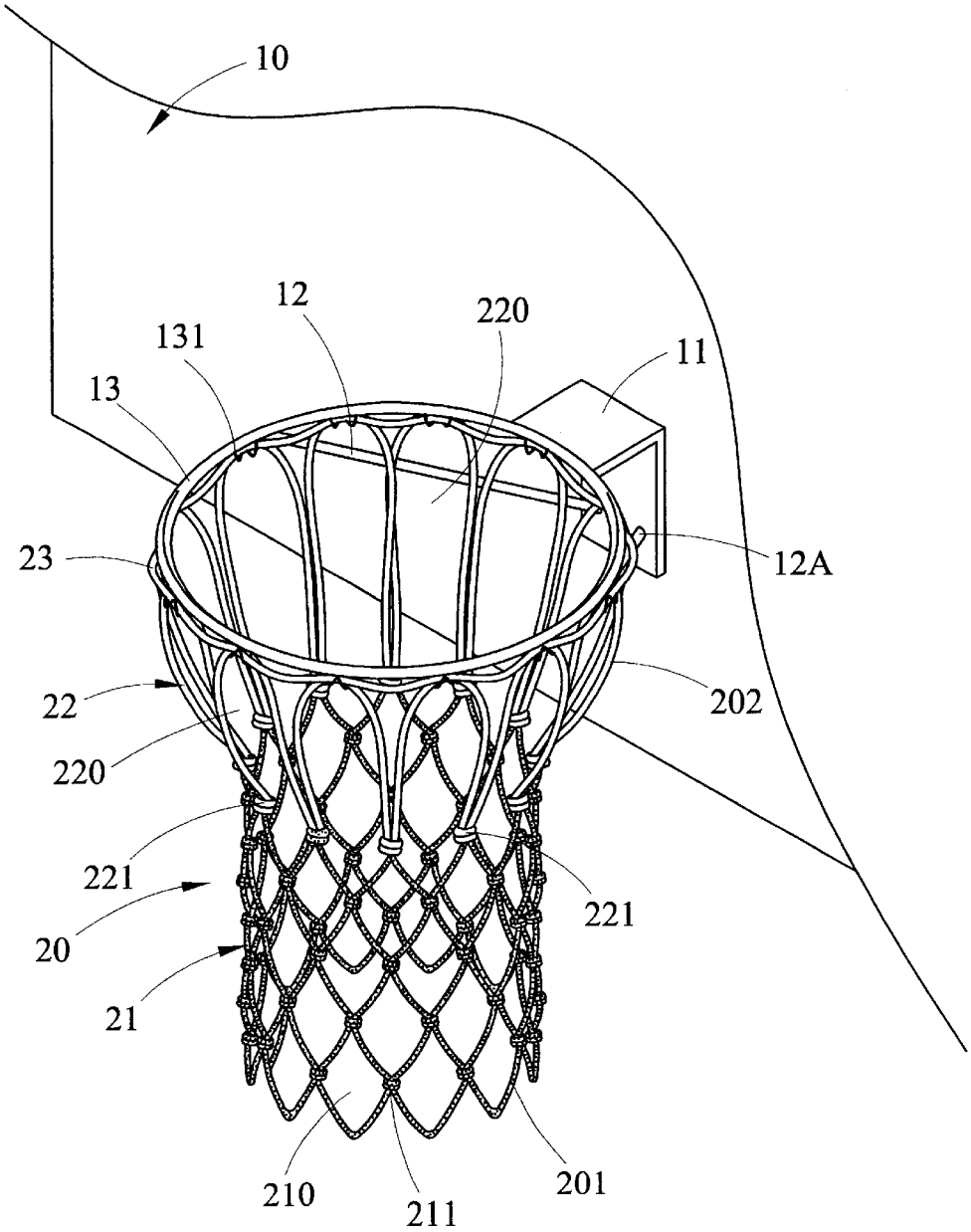
FIG. 1 is a perspective view showing the self-luminous basket net of the present invention being hung from the basket board of a basket ball frame.
Figure 2:
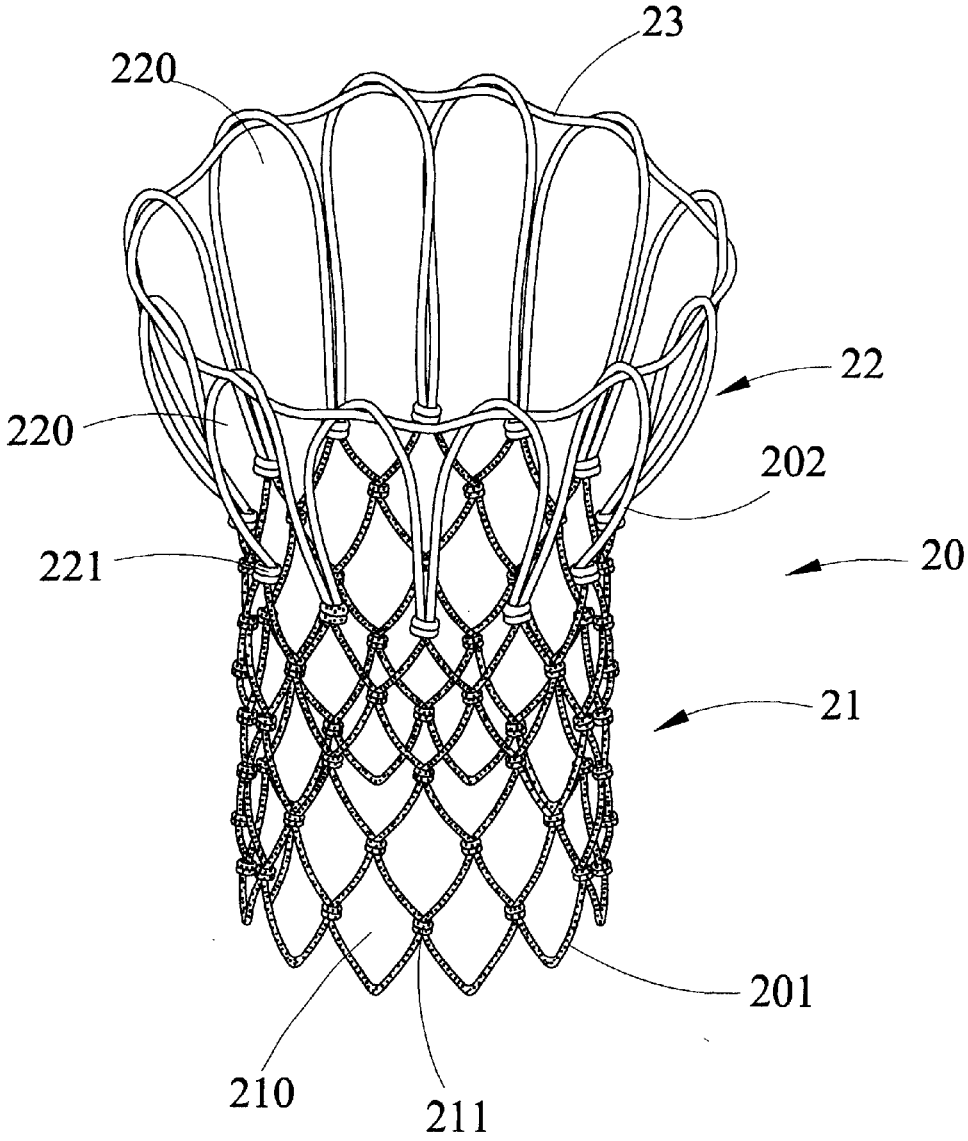
FIG. 2 is a perspective view of the self-luminous basket net according to the present invention.

Referring to FIGS. 1 and 2, the first embodiment of the self-luminous basket net of the present invention is illustrated. Referring to FIG. 1, below the center of the basket board 10 is firmly secured with an L shape supporter 11. Two arms 12, 12A extend from the supporter 11 so as to support an iron basket ring 13. The lower side of the iron basket ring 13 hangs with a basket net 20. The basket net 20 of the present invention comprises a fabric rope 201 fabricated by non-luminous fiber, which is fabricated to be formed with many knots 211 as a lower half basket net 21 with a plurality of meshes 210 and a monofilament 202 formed by luminous plastics, which is tied with the top of the lower half basket net 21 by tying knots 221 so as to be formed as upper half basket net 22 formed by a plurality of basket meshes 220 capable of being passed through by a basket ball. Then the plurality of luminous basket meshes 220 of the upper half basket net 22 encloses with a top of the basket net. A luminous plastic is used to connect the basket meshes 220 of the upper half as a basket net 20 having a basin shape.

The luminous plastic monofilament 202 is formed by extruding a monofilament of diameter 3.5~5.5/m. Basically, it has a proper flexibility so as to be tied with the lower half basket net 21 as an integral body. Furthermore, the monofilament must have a proper size, thereby, the shooter may view the basket net correctly. The luminous plastic monofilament must have a proper diameter. A luminous plastic ring 23 made with the monofilament 202 corresponds with the diameter of the upper half basket net 22.

In one embodiment, the upper half basket net has a self-luminous monofilament basket ring to be hung from an iron basket ring. In another embodiment, the plurality of basket meshes of the upper half basket net are serially connected with a monofilament basket ring and then combined together. Then an upper portion of the basket net is hung to the iron basket ring.

Each mesh 220 of the upper half basket net 22 of the basket net 20 formed by above method and the luminous plastic ring 23 are hung in a plurality of W shape hooks 131, i.e., it has an outlook as illustrated in FIG. 1. The luminous basket net 20 of the present invention illuminates at night so as to present a beautiful visual effect and provides an object to the shooter. With reference to FIG. 1, from the practical application, it is appreciated that the present invention may be used in the basketball field without illumination or with weak illumination.

Figure 3:
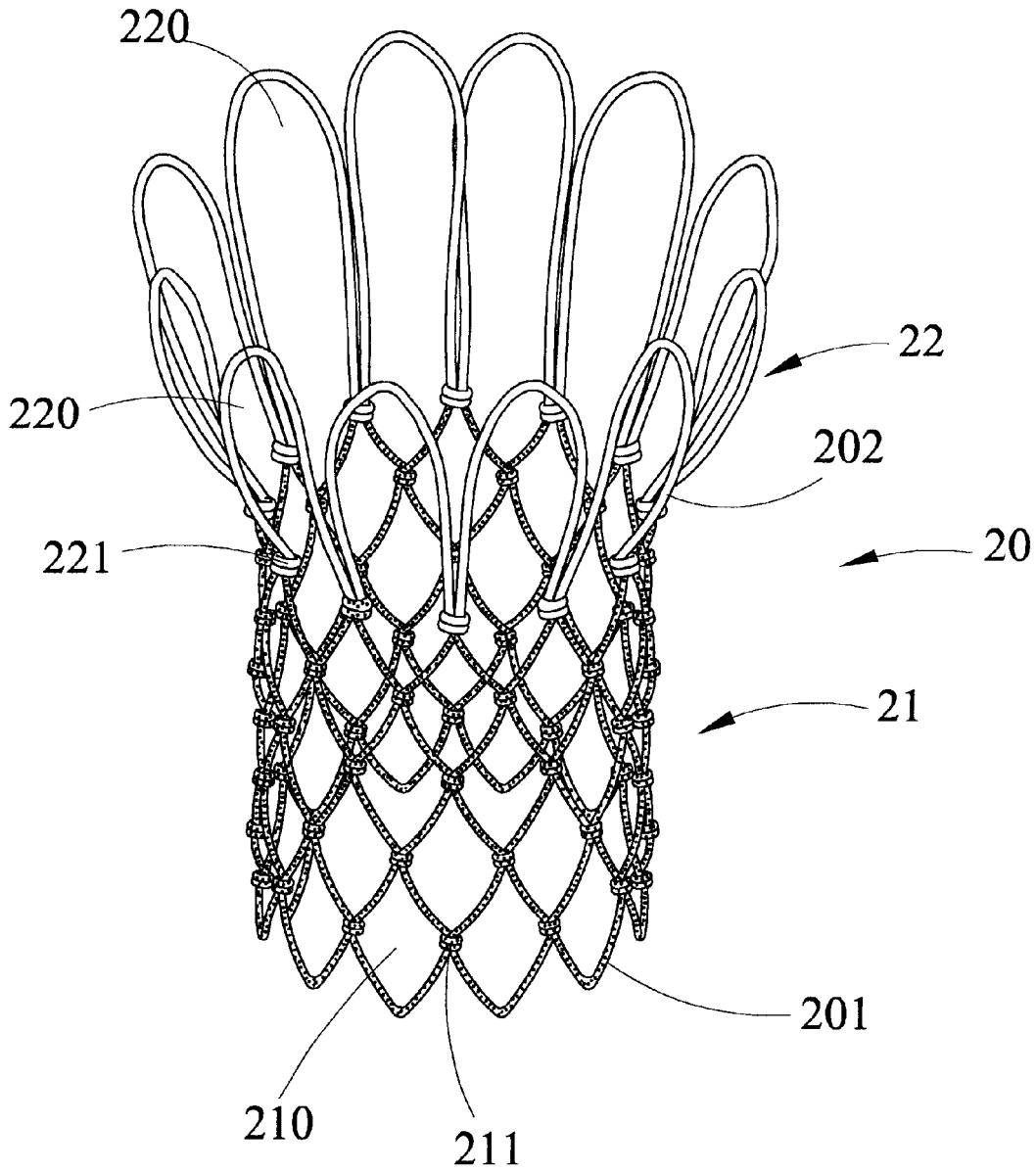
FIG. 3 is a perspective view of the luminous basket net in another embodiment of the present invention.

Another embodiment of the luminous basket net of the present invention is illustrated in FIG. 3. Most of the structure is like the first embodiment except that in this embodiment, the luminous plastic ring 23 at the top is neglected, while the top of each of the plurality of meshes 220 is hung to the W shape hook 131 installed on the iron basket ring 13 directly so that the shooter may see the basket ring by eyes. Therefore, although this embodiment of the present invention has no luminous plastic ring 23 is installed, it can still be also used effectively.

It should be noted that in the present invention, although the basket net of the present invention has a luminous upper half and a non-luminous lower half, it can also be designed so that the whole basket net is formed with luminous monofilament so that the whole basket net can be seen at night. Since the figures of this embodiment are identical to those in first embodiment. Therefore, the related drawings and description are neglected.

In summary, the basket net of the present invention has a luminous upper half and a non-luminous lower half so that the sportsmen (sportswomen) may play basket ball at a basket ball field without illumination or with a weak illumination by using the present invention.

The present invention are thus described, it will be obvious that the same may be varied in many ways. Such variations are not to be regarded as a departure from the spirit and scope of the present invention, and all such modifications as would be obvious.

What is claimed is:

1. A self-luminous basketball net to hang on hooks of a basketball ring comprising:

a) a first fiber material forming an upper half of the net, the first fiber material comprising a luminous monofilament; and, b) a second fiber material forming a lower half of the net, the second fiber being a non-luminous fiber, the second fiber having a plurality of knots forming a plurality of meshes, the first fiber material being tied to the second fiber material by a plurality of knots.

2. The self-luminous basketball net according to claim 1, further comprising:

a luminous ring made with a luminous monofilament, and extending around an upper opening of the upper half of the net.

3. The self-luminous basketball net according to claim 2, wherein the luminous ring is interconnected with meshes on a top of the upper half of the net.

4. The self-luminous basketball net according to claim 2, wherein the luminous monofilament is a flexible extruded plastic monofilament having a diameter between 3.5 and 5.5 mm.

* * * * *